US006220461B1

(12) United States Patent
Dickinson

(10) Patent No.: US 6,220,461 B1
(45) Date of Patent: Apr. 24, 2001

(54) SLANT SHELF SYSTEM

(75) Inventor: Robert P. Dickinson, Paragould, AR (US)

(73) Assignee: L.A. Darling Company, Paragould, AR (US)

( * ) Notice: Subject to any disclaimer, the term of this patent is extended or adjusted under 35 U.S.C. 154(b) by 0 days.

(21) Appl. No.: 09/349,820

(22) Filed: Jul. 8, 1999

(51) Int. Cl.[7] ..... A47F 5/08; A47B 57/04

(52) U.S. Cl. ..... 211/90.01; 211/90.02; 248/225.11; 108/42; 108/108

(58) Field of Search ..... 211/90.01, 90.02, 211/94.01; 108/42, 1, 108; 248/225.11, 220.22, 220.21

(56) References Cited

U.S. PATENT DOCUMENTS

| | | | | |
|---|---|---|---|---|
| D. 404,148 | * | 1/1999 | Laskowski et al. | D25/123 |
| D. 414,959 | * | 10/1999 | Emerson | D6/418 |
| 1,411,260 | | 4/1922 | Baker et al. . | |
| 4,098,480 | | 7/1978 | Neumann . | |
| 4,151,917 | * | 5/1979 | Pugh | 211/88.01 |
| 4,489,831 | | 12/1984 | Lahneman, III . | |
| 4,498,653 | * | 2/1985 | Quest | 108/108 X |
| 4,583,648 | | 4/1986 | Buffington et al. . | |
| 4,756,430 | | 7/1988 | Spamer et al. . | |
| 4,874,148 | | 10/1989 | Guinter . | |
| 5,199,579 | * | 4/1993 | Van Duyne | 211/90.04 |
| 5,228,579 | * | 7/1993 | Kaufman | 211/94.01 |
| 5,429,252 | * | 7/1995 | Liu | 211/94 |
| 5,535,972 | | 7/1996 | Fallago . | |
| 5,582,376 | | 12/1996 | Thompson . | |
| 5,769,520 | | 6/1998 | Jun et al. . | |
| 5,924,367 | * | 7/1999 | Henke et al. | 108/108 |
| 5,944,203 | * | 8/1999 | Vlah et al. | 211/94.01 X |
| 5,960,965 | * | 10/1999 | Saunders | 211/90.01 X |

OTHER PUBLICATIONS

P. 40 of Spartan Showcase Inc. Price List—'91 (Effective Jun. 3, 1991 for Catalog #R–87).

Pp. 117 and 118 from Central Sales Promptions, Inc. "Point–of–Purchase Merchandsing Products" Catalog.

Brochure for International Visual Corporat6ion "Signature Slatwell Strength and Designer Aesthetics with No Compromise".

* cited by examiner

*Primary Examiner*—Daniel P. Stodola
*Assistant Examiner*—Erica B. Harris
(74) *Attorney, Agent, or Firm*—Piper Marbury Rudnick & Wolfe

(57) ABSTRACT

A slant shelf system features a slatwall with slats separated by grooves. Each groove contains two or more channels. An adapter clip features two or more slits and a lip sized to engage the channels. A shelf features side, front and rear walls. The rear wall includes a flange attached to its upper end. Tabs extend down from the flange and are sized to engage the slits of the adapter clips. By selectively positioning the lip of the adapter clips in the channels of the slatwall and the tabs of the shelf into the slits of the adapter clip, the shelf may be mounted at various tilt angles with respect to the slatwall.

16 Claims, 2 Drawing Sheets

SLANT SHELF SYSTEM

BACKGROUND OF THE INVENTION

1. Field of Invention

The invention relates generally to store fixtures and, more particularly, to a slant shelf system that utilizes an adapter clip to secure a shelf to a slatwall so that the shelf may be slanted at multiple angles to provide easier overhead access.

2. Description of Prior Art

Ergonomically designed work environments reduce worker fatigue and the likelihood of injury. As a result, worker productivity is increased. Ergonomic considerations are thus receiving increased attention in the design of office furniture, machinery, vehicles, storage systems and the like.

A pharmacist or technician must access a variety of pharmaceuticals as he or she fills prescriptions and assists customers. From an ergonomic perspective, it is preferable that the pharmacist or technician not be required to bend or stretch to retrieve the pharmaceuticals. As a result, it is desirable to position the pharmaceuticals within easy reach of the pharmacist or technician. This may be accomplished by storing the pharmaceuticals on shelves mounted upon the pharmacy wall.

To optimize space in the pharmacy, it is often desirable to position some of the shelves above the head of the pharmacist or technician. It is preferable to tilt these shelves so that the pharmacist or technician may reach their contents without stretching. In other words, the shelves should be tilted to bring the pharmaceuticals placed thereon closer to the technician or pharmacist.

Tiltable shelving systems are known in the art. For example, U.S. Pat. No. 5,199,579 to Van Duyne discloses a shelf with a number of attaching devices secured to its backside. Each attaching device is constructed from a wire extrusion that fits through the openings of a shelf standard or the like. The wire is bent so that first and second stops are formed. The first stop engages the shelf standard so that the shelf is secured in a generally horizontal position. When the second stop is utilized, the shelf is tilted downwards.

A disadvantage of the attaching device of the Van Duyne '579 patent, however, is that the number of angles at which the shelf may be tilted is limited. The embodiment illustrated in the patent, for example, provides only the horizontal position and one tilted position. Shelf systems that may be adjusted to a larger variety of angles allow shelves of varying depths to be used more effectively. While additional stops may be added to the attaching device of the Van Duyne '579 patent, their number is severely limited by the size of the attaching device. More specifically, a length of wire may feature only a limited number of bends. Furthermore, the length of the wire forming the attaching device must be limited to allow the attaching device to engage the shelf standard.

U.S. Pat. No. 4,583,648 to Buffington et al. discloses a shelf with an attachment plate having arms extending therefrom. The arms feature notches that engage the openings of a shelf standard or the like. As with the Van Duyne '579 patent, the number of tilt angles provided by the notched arms is restricted in that the arms may only accommodate a limited number of notches. Two notches for each arm are shown in the patent. The length of the arms must be limited to allow the shelf standard to be engaged. As a result, to obtain further tilt angles, the shelf of the Buffington '648 patent must include pivots in addition to the notched attachment plate. The pivots increase the cost of manufacturing the shelf and the complexity of adjusting the shelf tilt angle.

U.S. Pat. No. 4,098,480 to Neumann discloses a shelf system that features shelf brackets with arm and tab portions joined by pivots. The arm portions of two shelf brackets cooperate to support the shelf while the tab portions engage a shelf standard or the like. The pivots allow the arms, and therefore the shelf, to tilt with respect to the tab portions and the shelf standard. A series of holes are placed through the tab and arm portions of a bracket. The holes align when the arm is positioned at various tilt angles. A pin is placed through the aligned holes to secure the arm in the selected tilt position.

While the Neumann '480 patent allows a shelf to be tilted at a number of angles, the procedure to do so is somewhat awkward. More specifically, the user must position the arm in the desired position while aligning the holes in the arm and tab portions and insert the pin through the aligned holes. This procedure must be repeated for each bracket and there are at least two such brackets per shelf. As a result, adjusting a number of shelves can be time consuming.

The cost of manufacturing the brackets of the Neumann '480 patent would also be relatively high as compared to simpler brackets in that the tab and arm portions would have to be secured together by a pivot.

SUMMARY OF THE INVENTION

It is an object of the present invention to provide a slant shelf system with improved ergonomic features.

It is a further object of the present invention to provide a slant shelf system that provides a variety of shelf tilt angles.

It is another object of the present invention to provide a slant shelf system that allows shelf tilt angles to be easily adjusted.

It is still another object of the present invention to provide a slant shelf system with components that may be inexpensively and easily produced.

The present invention is directed to a slant shelf system. A slatwall features slats separated by a number of grooves. Each groove features two or more channels. An adapter clip includes a lip sized to engage each of the channels of the slatwall grooves. The adapter clip also features two or more slits.

A shelf features a rear wall, a front wall and a pair of side walls. A flange is attached to the upper edge of the rear wall. A pair of tabs extend downwards from the flange, each sized to engage one of the slits of an adapter clip. The shelf may be mounted via the adapter clips to the slatwall at various tilt angles by selectively positioning the lips of the adapter clips in the channels of the slatwall grooves. Additional various tilt angles may be achieved by selectively positioning the tabs of the shelf in each of the slits in the adapter clips. The adapter clip and shelf each may be inexpensively manufactured from a sheet of material such as metal.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
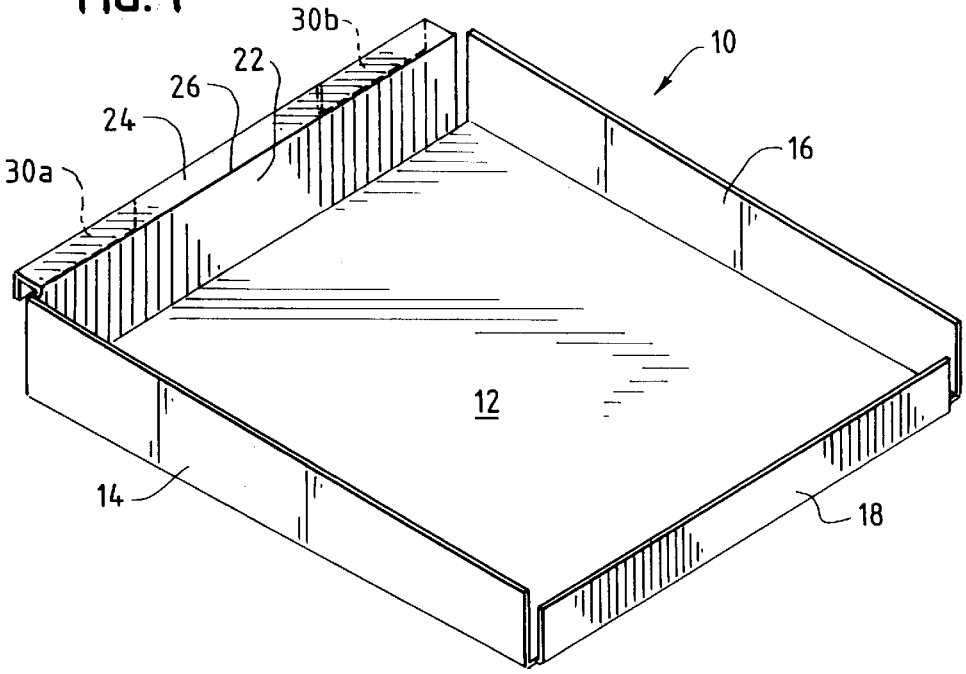
FIG. 1 is a perspective view of a shelf suitable for use with an embodiment of the slant shelf system of the present invention.
Figure 2:
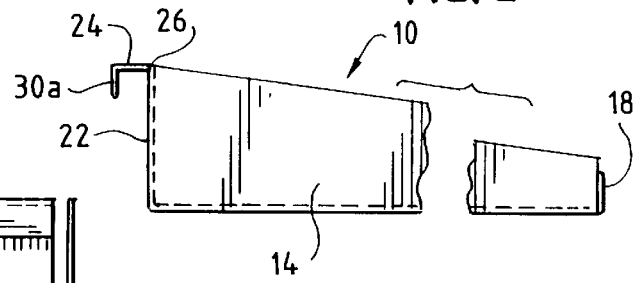
FIG. 2 is a fractured side elevational view of the shelf of FIG. 1.
Figure 3:
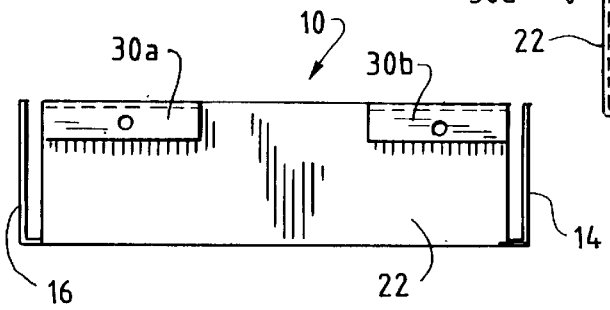
FIG. 3 is a rear elevational view of the shelf of FIG. 1.

An embodiment of a shelf suitable for use with the slant shelf system of the present invention is indicated in general at 10 in FIGS. 1–3. The shelf features a bottom 12, side walls 14 and 16 and front and rear walls 18 and 22, respectively. The four walls are sized so that the appropriate products may be retained upon the shelf. Furthermore, rear wall 22 is taller than the front wall 18. Accordingly, side walls 14 and 16 taper down towards the front wall. This allows an individual to more easily access products on the front of the shelf. The back wall features a flange 24 extending from its upper edge 26. A pair of tabs 30*a* and 30*b* extend down from the flange. The function of the flange and tabs will be discussed below.

The shelf may be inexpensively constructed from a single sheet of bendable material such as 16 Gage Hot Rolled Steel. More specifically, the sheet may be cut so that the side walls, front wall and rear wall are defined and connected by their lower edges to the bottom 12. The sheet of material may also be cut so that the rear wall includes an additional portion that may be folded to form the flange 24 and tabs 30*a* and 30*b*. Accordingly, the four walls may be folded up around the bottom and the rear wall may be folded so that the flange and tabs are formed.

Figure 4:
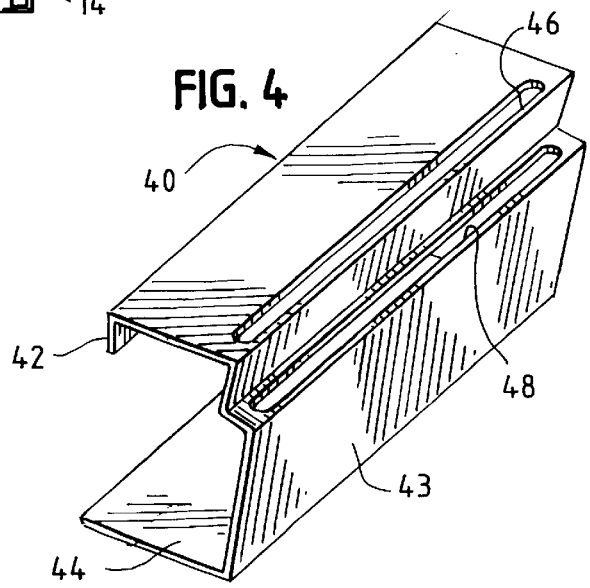
FIG. 4 is a perspective view of an adapter clip suitable for use with an embodiment of the slant shelf system of the present invention.
Figure 5:
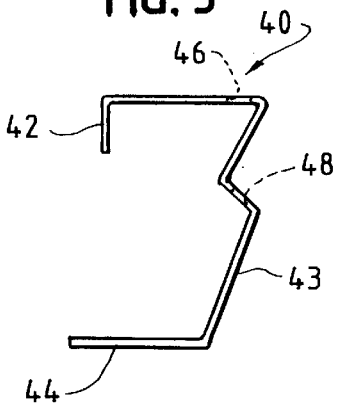
FIG. 5 is a side elevational view of the adapter clip of FIG. 4.

An adapter clip suitable for use with the shelf described above and the slant shelf system of the present invention is indicated in general at 40 in FIGS. 4 and 5. The clip features a lip 42, a shelf-rest portion 43 and a lower portion 44. An upper slit 46 and lower slit 48 are formed in the clip between the lip 42 and shelf-rest portion 43. Upper and lower slits 46 and 48 are sized to receive one of the tabs of 30*a* or 30*b* of the shelf of FIGS. 1–3. Like the shelf, clip 40 may be inexpensively manufactured from of a bendable material such as 16 Gage Hot Rolled Steel.

The cross-section of a portion of a slatwall suitable for use with an embodiment of the slant shelf system of the present invention is indicated in general at 50 in FIGS. 6A–6D. The slatwall features a number of slats 52 separated by grooves 54. Each groove features a front channel 56 and a rear channel 58. As illustrated in FIGS. 6A–6D, the slat and groove pattern is preferably present on both sides of slatwall 50. This allows both sides to support shelves if the slatwall is utilized in a free-standing configuration. The slatwall preferably is constructed of a strong material such as aluminum or metal.

The shelf of FIGS. 1–3, indicated in general at 10 in FIGS. 6A–6D, may be mounted in a horizontal fashion to slatwall 50 by inserting tabs 30*a* and 30*b* (FIGS. 1–3) into the rear channel 58. Alternatively, the shelf may be slightly tilted by inserting the tabs into the front channel 56.

FIGS. 6A–6D illustrate how the adapter clip 40 of FIGS. 4 and 5 may be utilized to achieve a variety of steeper tilt angles for shelf 10. While two adapter clips are used to attach shelf 10, that is, one for tab 30*a* and one for tab 30*b* (FIGS. 1–3), the process will be described with regard to a single adapter clip and tab 30*a* only in order to eliminate redundancy.

Figure 6A:
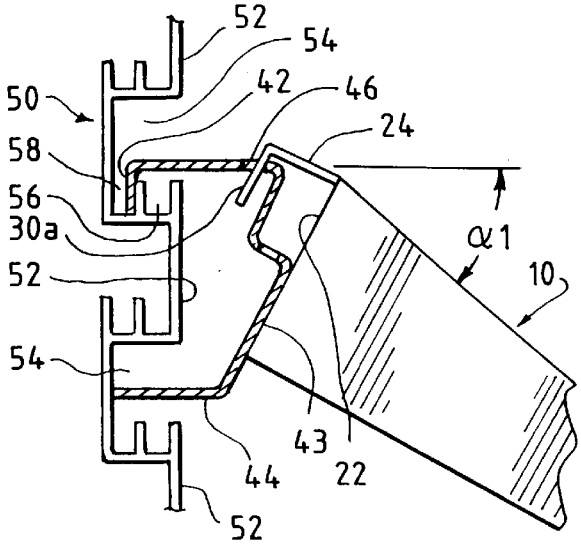
FIGS. 6A–6D are side elevational views of the adapter clip of FIG. 4, fractured side elevational views of the shelf of FIG. 1 and partial sectional views of a slatwall suitable for use with an embodiment of the slant shelf system of the present invention illustrating various tilt configurations.

As shown in FIG. 6A, tilt angle $\alpha 1$ may be obtained by inserting the lip 42 of the adapter clip into the rear channel 58 of the slatwall. The lower portion 44 of the clip rests in the neighboring slatwall groove below. In FIG. 6A, the shelf is attached to the adapter clip by inserting its tab 30*a* into the upper slit 46 of the clip. As a result, the rear wall 22 of the shelf rests against the shelf-rest portion 43 of the adapter clip. As an example only, the configuration of FIG. 6A may provide a tilt angle $\alpha 1$ of approximately 15°. Differing angles may be obtained by adjusting the dimensions of front and rear channels 56 and 58 of the slatwall 50, the lip 42 of the adapter clip and the flange 24 of the shelf 10.

Figure 6C:
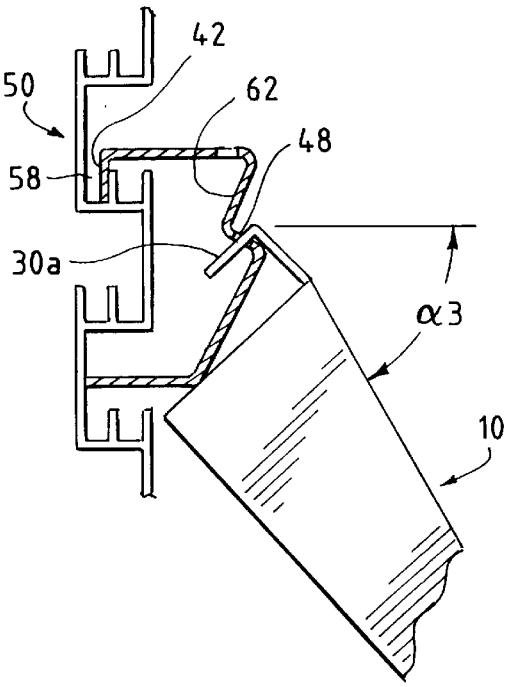
Figure 6B:
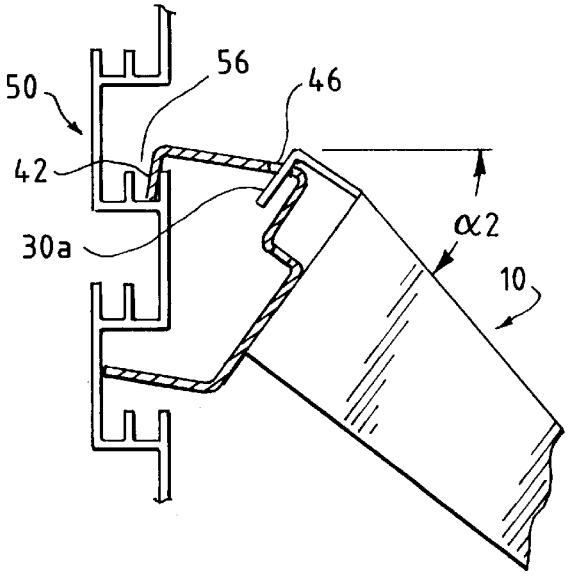
Figure 6D:
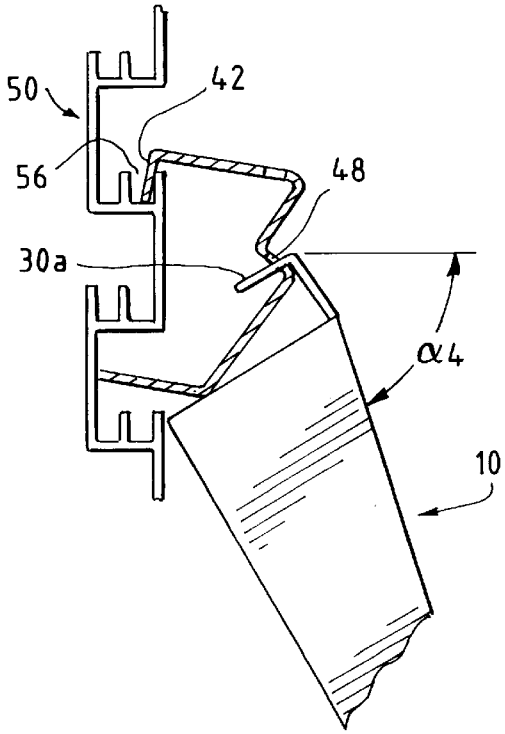

As illustrated in FIG. 6B, a steeper tilt angle, $\alpha 2$, may be achieved by moving the lip 42 of the adapter clip to the front channel 56 of the slatwall. In this position, the tab 30*a* of the shelf continues to rest in the upper slit 46 of the clip and the rear wall of the shelf continues to rest against the shelf-rest portion of the clip. As an example only, the configuration illustrated in FIG. 6B may provide a tilt angle $\alpha 2$ of approximately 20°.

FIG. 6C illustrates a configuration where the lip 42 of the adapter clip has been returned to the rear channel 58 of the slatwall 50. The tab 30*a* of the shelf 10, however, has been moved to the lower slit 48 of the adapter clip. As an example only, the configuration illustrated in FIG. 6C may provide a tilt angle $\alpha 3$ of approximately 25°. The additional tilt provided by moving the tab of the shelf to the lower adapter slit will depend upon the dimensions of the portion of the adapter between its upper and lower slits, indicated at 62 in FIG. 6C.

The lip 42 of the adapter clip may be moved to the front channel 56 of the slatwall 50, while the tab 30*a* of the shelf remains in the lower adapter slit 48, to obtain an even steeper tilt angle $\alpha 4$. As an example only, the configuration illustrated in FIG. 6D may provide a tilt angle $\alpha 4$ of approximately 30°.

As a result, the shelving system of the present invention allows shelves to be mounted at tilt angles that are optimal for product retrieval by, for example, a pharmacist or technician. The pharmacist or technician thus may retrieve a product without excessive reaching or stretching. The steeper tilt angles are desirable when deeper shelves are used.

It should be noted that the adapter clip 40 of FIGS. 4 and 5 may include additional slits so that a greater number of shelf tilt angles may be obtained. Additional channels may also be added to the grooves of slatwall 50 of FIGS. 6A–6D for the same purpose. Furthermore, the width of the adapter clip and the slits therein may be increased so that a single clip may accommodate an entire shelf.

While the preferred embodiments of the invention have been shown and described, it will be apparent to those skilled in the art that changes and modifications may be made therein without departing from the spirit of the invention, the scope of which is defined by the appended claims.

What is claimed is:

1. A slant shelf system for mounting on a slatwall comprising:

a) a shelf including:
  i) a bottom;
  ii) a rear wall attached to said bottom;
  iii) a flange mounted to the rear wall;
  iv) at least one tab extending downward from said flange;

b) an adapter clip including:

i) a lip adapted to engage the grooves of slatwall;

ii) at least one slit, said slit sized to receive the at least one tab of said shelf;

iii) a slanted shelf-rest portion positioned beneath said slit and tilted with respect to the slatwall when the lip is engaging the slatwall, said shelf-rest portion engaging the rear wall of said shelf when said tab of said shelf is positioned in the slit of said adapter clip;

whereby said shelf may be mounted via said adapter clip to said slatwall so that said shelf is slanted at a tilt angle with respect to said slatwall.

2. The slant shelf system of claim 1 wherein said adapter clip features multiple slits so that said shelf may be mounted via said adapter clip to said slatwall at various tilt angles by selectively positioning the tab of said shelf in each of the plurality of slits in the adapter clip.

3. The slant shelf system of claim 1 wherein said adapter clip includes a lower portion that engages said slatwall.

4. The slant shelf system of claim 1 wherein said shelf also includes side and front walls.

5. The slant shelf system of claim 4 wherein said rear wall is taller than said front wall and said side walls taper down from said rear wall to said front wall.

6. The slant shelf system of claim 1 wherein said shelf is made from a single sheet of material.

7. The slant shelf system of claim 1 wherein said adapter clip is made from a single sheet of material.

8. A slant shelf system comprising:

a) a slatwall including a plurality of slats separated by a plurality of grooves, each of said grooves featuring a plurality of channels disposed in a bottom thereof;

b) an adapter clip including:

i) a lip adapted to engage each of the plurality of channels of the grooves of said slatwall;

ii) at least one slit;

iii) a slanted shelf-rest portion positioned beneath the slit and tilted with respect to the slatwall when the lip is engaging said slatwall;

c) a shelf including:

i) a bottom;

ii ) a rear wall attached to said bottom:

iii) a flange mounted to the rear wall:

iv) at least one tab extending downward from said flange, said tab sized to engage the at least one slit of said adapter clip so that the rear wall of said shelf en gages the shelf-rest portion of said adapter clip;

whereby said shelf may be mounted via said adapter clip to said slatwall at various tilt angles by selectively positioning said lip in each of the plurality of channels of the grooves of said slatwall.

9. The slant shelf system of claim 8 wherein said adapter clip features multiple slits so that said shelf may be mounted via said adapter clip to said slatwall at additional various tilt angles by selectively positioning the tab of said shelf in each of the plurality of slits in the adapter clip.

10. The slant shelf system of claim 8 wherein said adapter clip includes a lower portion that engages said slatwall.

11. The slant shelf system of claim 8 wherein said shelf also includes side and front walls.

12. The slant shelf system of claim 11 wherein said rear wall is taller than said front wall and said side walls taper down from said rear wall to said front wall.

13. The slant shelf system of claim 8 wherein said shelf is made from a single sheet of material.

14. The slant shelf system of claim 8 wherein said adapter clip is made from a single sheet of material.

15. An adapter clip for mounting a shelf having a bottom, a rear wall, a flange extending from said rear wall, and a tab extending downward from said flange on a slatwall comprising:

a) a lip for engaging a groove said slatwall;

b) a slit sized to receive the tab of said shelf;

c) a slanted shelf-rest portion positioned beneath the slit and tilted with respect to said slatwall when the lip is engaging said slatwall, said shelf-rest portion engaging the rear wall of said shelf when said shelf is mounted to said adapter clip.

16. The slant shelf system of claim 15 wherein said adapter clip features multiple slits so that the shelf may be mounted via said adapter clip to the slatwall at additional tilt angles by selectively positioning the tab of the shelf in each of the plurality of slits in the adapter clip.

* * * * *